United States Patent [19]

Smith, II

[11] 4,021,593

[45] May 3, 1977

[54] NEEDLED FABRIC STRUCTURE

[75] Inventor: Alexander M. Smith, II, Elkin, N.C.

[73] Assignee: The Fiberwoven Corporation, Elkin, N.C.

[22] Filed: Apr. 10, 1975

[21] Appl. No.: 567,010

Related U.S. Application Data

[60] Division of Ser. No. 371,725, June 20, 1973, Pat. No. 3,906,599, which is a continuation-in-part of Ser. No. 221,614, Jan. 28, 1972, Pat. No. 3,817,820.

[52] U.S. Cl. ..... 428/300; 428/289; 428/290; 428/292; 428/299

[51] Int. Cl.[2] ..... B32B 5/06

[58] Field of Search ..... 428/289, 290, 299, 300, 428/292; 28/72.2 R

[56] References Cited

UNITED STATES PATENTS

| | | | |
|---|---|---|---|
| 2,381,184 | 8/1945 | Ripley | 428/300 |
| 3,206,351 | 9/1965 | Smith | 428/113 |
| 3,623,935 | 11/1971 | Allman | 28/72.2 R |
| 3,817,820 | 6/1975 | Smith | 428/300 |

*Primary Examiner*—Marion E. McCamish
*Attorney, Agent, or Firm*—Cushman, Darby & Cushman

[57] ABSTRACT

An improved needled fabric structure having superior fiber entanglement and produced by an improved needling method and needle machine. The improved needled fabric structure has fibers coherently oriented throughout the batt from one surface to the other in a plurality of rows of fibers extending in a generally lengthwise direction of the batt with each of the rows of fibers being a continuous chain entanglement of fibers from one surface to the other, and at least some of the rows of chain entanglement of fibers crossing, recrossing, and extending through other of the rows of chain entanglement of fibers.

5 Claims, 6 Drawing Figures

10
12
14
16
18
20
22
24
26
28
30
32
34
36
38
40
42
44
46
48
50
52
60
72
76
96
104
106
110
112
114
116
118
120
122
124
126
128
130
132
134
138
140
142
144
146
148
150
A
B
C

NEEDLED FABRIC STRUCTURE

The present application is a continuation in part application of my U.S. division of application Ser. No. 371,725 filed June 20, 1973, now U.S. Pat. No. 3,906,599 issued Sept. 23, 1975, which in turn was a application Ser. No. 221,614 filed Jan. 28, 1972 and entitled "NEEDLE TEXTILE FABRIC" , now U.S. Pat. No. 3,817,820, issued June 18, 1974.

BACKGROUND OF THE INVENTION

The invention relates to a new and improved needled fabric structure having increased fiber entanglement and a coherent fiber structure, the needled fabric structure utilizing a new method and needle machine having an improved means for controlling the feed of the web composite through the needling area.

In recent years, there has been considerable development in the needling of fibers to produce needled fabric structures. Generally the textile industry has found that density of a needled fabric structure may be increased by increasing the depth of needle penetration or by increasing the number of punches to which the web is subjected and this latter may be done by multi-passing of the structure through the loom. Of course, the fabric structure can only be punched a certain number of times; otherwise, it produces such a dense structure that it causes the needles of the needle loom to break or the structure itself to disintergate with further needling.

To improve the fiber entanglement within a needled fiber structure and hence those physical properties based on the quality of fiber entanglement, it has been found that less depth of needle penetration through a fiber web and smaller advances between successive penetrations of a given needle must be used. With such improved fabrics, certain problems only vaguely recognized in the prior art become acute. Thus, in previous methods of needling fiber webs, the art has observed an undesirable surface pattern phenomenon which has been referred to as needle tracking. The visual effect is a series of linear scars of varying width and intensity running in the direction of machine feed. Because of the desirability of producing a product with a uniform surface, this linear surface effect has been investigated in detail, but the art has not been able to determine precisely the cause thereof. It is believed, however, that misplaced, bent, or irregular needles and/or the feed interval of the fiber web contribute to the tracking phenomenon.

An article, "Needled Nonwovens: The Problems Of Tracking" Part I-Cause And Effect and Part II-Some Solutions by G. Young appearing respectively in the February and March, 1970 issues of "Textile Month" printed in England at the Buxton Press, Buxton, Derbyshire, describes considerable research effort directed toward determining the cause of such linear surface tracking and accordingly developing methods of obviating the same. While no definite solutions to the problem of tracking were found, the results show that tracking becomes more acute as the distance between successive needle punches of a particular needle decreases, i.e., as the number of successive needle punches per linear inch increases. Accordingly, in order to somewhat mitigate the problem, the Young reference indicates that large distances between successive needle punches should be practiced. Further, Young indicates that by moving the web of fibers laterally with respect to the feed direction, the nature of tracking can be affected. However, the tracking still exists and, essentially, only the surface appearance is changed.

In a manner somewhat similar to the suggestion of Young, U.S. Pat. No. 3,535,756 to Kuts et al, issued Oct. 27, 1970, suggests oscillating a web during the needling operation whereby lateral movement of the web is accomplished by the draw-off rolls of the needle loom. The web is held, essentially, in a tensioned condition during the needle operation by means of a restrictive inlet throat guiding the web into the needling area. However, so far as the Kuts et al method is concerned, conventional distances between successive needle punches are practiced in conventional machines using conventional methods. The conventional distance between successive punches of a given needle would be normally at least one-quarter inch. As illustrated by Young, these longer distances between successive needle punches in and of themselves tend to mitigate linear tracking. Likewise, Kuts et al does not propose his method for mitigating tracking for needle processes which utilize distances between successive needle punches other than the conventional distances.

As an alternate proposal in the art, U.S. Pat. No. 3,150,434 to O'Byrne, issued Sept. 29, 1964, suggest intermittently moving a web of fibers through a needling area and reciprocating the web during passage thereof through the needling area. Here again, conventional distances between successive needle penetrations are envisioned.

As can be appreciated from the above brief summaries of the relevant prior art, the effort to improve surface appearance by reducing needle tracking has assumed conventional distances between successive needle penetrations of a particular needle, i.e., normally at least one-quarter inch.

Unfortunately, these conventional distances between successive needle punches of a particular needle are not always capable of producing a superior fiber entanglement and coherent fiber structure which is desired for some products and, therefore, short advances between successive penetrations of a given needle are necessary. Tracking in these superior needled fabrics presents a far more serious problem than that which existed with the prior conventional needled fabrics, where appearance was the primary consideration.

While not bound by theory, it is believed that the fiber involvement by a relatively short distance between successive needle penetration so orients the fibers of the needle batt that succeeding needles are, in effect, guided again into the previously needled areas and intensify the tracking difficulty. Thus, with the shorter distances between needle penetration, the tracking produces rows of densely needled fibers separated by areas of considerably less needled fibers, similar to the appearance of a plowed field.

While surface linear tracking of the aforenoted nature in these superior products is not necessarily undesirable for some applications, it should be appreciated that such tracking affects the interior of the fiber structures and can produce non-uniformities of properties which often become evident when the needled fabric is subjected to stress. In order to mitigate the tracking of this nature in these superior products, it has been found that special means are necessary for reducing the tendency of successive needles to follow in the path or track of earlier needles. Briefly, it is necessary that the needling with the short distances between successive needle penetrations be performed while the web is under relatively low tension and preferably under the minimum tension required for reasonably uniform feeding of the fiber web into and through a needling loom. Additionally, the web must be free to move transversely while passing through the needling zone. Also, it is important and preferred that the movement in the transverse direction decreases, generally, in amplitude as the web passes through the needling zone. With such provisions during the needling operation, the tracking noted above may not only be substantially mitigated, but it has been additionally discovered that the needling effectiveness, as indicated by the physical properties of the resulting fabric, is significantly increased.

For purposes of the present specification, the relatively short distances between successive needle penetrations are herein defined as those distances which allow a successive needle penetration to involve fibers involved by the previous penetrations. Generally speaking, involvement of fibers of the foregoing nature will be accomplished when at least seven needle penetrations per linear inch are performed by a particular needle.

BRIEF SUMMARY OF THE INVENTION

The present invention relates to a novel needled fabric structure produced from a web or composite of fibers having some structural integrity, the needled fabric structure being made by a novel machine and method.

Throughout the specification, the term "web of fibers having some structural integrity" is defined as a web of loosely matted fibers which have been needled at least once to give some structural integrity to the web, or a web of loosely matted fibers having a foundation so that there is some structure to the composite which enables the method to be accomplished thereon when the web is moving or to a web of loosely matted fibers which have been "tacked" needled to give some body or structural integrity to the web. Of course, the term does include a web which has made more than one pass through a needling operation wherein its structural integrity is substantial.

In my aforementioned copending U.S. application Ser. No. 221,614, the method of the present invention is disclosed. According to that method, a web or composite is fed into a needling loom with a minimum amount of tension so that the web or composite will have some degree of freedom for random movement in a transverse direction as it passes into and through the needle loom. The minimized machine direction tension on the web or composite will allow the same to wander or wobble slightly in the transverse direction while passing through the loom and this random transverse movement improves the effectiveness of the needle operations.

It is important that the needling be carried out under minimum tension, as noted above, in order that the web be free to move in the transverse direction to the web movement in the feed direction in a manner which will accomplish the desired needling action to obviate the difficulty with tracking. In one regard, this may be accomplished by simply allowing the web sufficient freedom to wander or wobble in a non-controlled and random fashion as it is fed in and through the needling area; that is, without a specific guiding means. This freedom, however, must be consistent with feeding the web into the needling area and preventing the web from folding, doubling, or jamming as it enters and passes through the needling operation. Similarly, of course, this minimum tension must be consistent with keeping the web moving into and through the needling zone, and with these reservations being observed, the minimum tension for the preferred embodiment will allow the random wandering or wobbling.

However, when relatively high production of needled fabric is to be accomplished, the unpredicted and random wandering of the web may not be sufficient to insure sufficient translation of the web to obviate the linear surface tracking and associated non-uniformities of internal structure. In this case, it is preferred to provide a positive means for both feeding the web with minimum tension and positively guiding or oscillating the substantially untensioned web prior to its entering the needling zone. When this positive oscillation is performed, it is important that the oscillation be performed on the web prior to entering the needling zone, as opposed to a positive oscillation of the web exiting from the needling zone. Oscillation from the exit end of the needling zone is not capable of transmitting the oscillations backwardly entirely through the web within the needling zone. Accordingly, in this embodiment of the invention, the oscillation must be performed from the entry end of the needling zone.

The web of fibers having some structural integrity is advanced from a source of supply to a needling zone or area and prior to its entering the needling zone or area, the web is positively placed in a substantially untensioned condition by a festoon or the like before the inlet of the needle area and is then fed through the needling zone or area while in this condition. The advancement for the web is provided by draw rolls located at a remote point from the outlet of the needling zone or area and these draw rolls may be either continuously rotated or rotated in step by step increments. By having the web of fibers in a substantially untensioned condition prior to needling, the portion of the web within the needling zone or area will remain substantially relaxed even though the draw rolls are continuously rotated and even though the needles may happen to be in the web tending to restrain the web momentarily between the needling zone or area and the draw rolls. The untensioned condition of the web at the inlet permits the looseness of the web to be reflected into the needling zone so that the needles can perform their intended purpose to the web.

Coupled with the above, the web advancing toward the needling zone or area at its inlet is positively reciprocated in a transverse direction to the direction of movement of the web through the needling zone or area. This produces cyclic oscillations in the web through the entire needling zone with the oscillations having decreasing translating amplitudes in the forward direction. The transverse movement of the untensioned web back and forth just prior to the inlet of the needle area does not result in oscillations being transferred rearwardly in the web to the supply for the web as the means for maintaining the web in a substantially untensioned condition forward of the inlet to the needling zone or area absorbs these oscillations. As mentioned heretofore, the draw rolls are positioned on the outlet of the needling zone remotely forward of the same and, thus, the oscillations extend through the entire needle zone.

For the purpose of this specification, the term "needling zone" or "needling area" is defined as the section of a needle loom lying between the feed rolls and the draw rolls. In this area, there is an array of needles in successive rows which may be mounted in a single or a plurality of needle boards arranged on one or both sides of the web to be needled.

In the present invention and in one of the preferred embodiments of the same, a fiber chain entanglement is produced in the needling zone or area and this fiber chain entanglement may be produced by needle looms such as disclosed in U.S. Pat. Nos. 3,112,552 and 3,132,406. The disclosures of these patents are incorporated herein by reference and the fiber chain entanglement disclosed therein is now referred to in the art by way of the trademark FIBERWOVEN or FIBERWOVEN looms and for convenience in this specification, this terminology will be used hereinafter.

"Chain entanglement" is defined as intermingling, interlooping and/or interlacing of fibers were coherence results from continuous entanglement of fibers oriented along a plane lengthwise of the fabric.

Briefly, the term "interlooping" defines a subsurface binding together of fibers in a web or the like of loosely matted fibers, the bonding being accomplished by passing fibers through the loops of other fibers previously oriented below the surface of the web. Interlooping of fibers is akin to knitting as it provides entanglement of fibers by loop engagement rather than a binding by a tying action. On the other hand, the term "interlacing" is intended to define a binding together of fibers primarily from one outside surface of the web to the other outside surface of the web. Interlacing of fibers is somewhat similar to a sewing action, although it does not depend on a continuous threaded action. In interlacing, the ends of fibers lying on and/or adjacent to one surface are carried through the web body and then at least partially returned toward the initial side by another path with other fibers from and/or adjacent to the other surface so as to become oriented in a manner analogous to a thread in sewing as distinguished from interlooping where the binding is confined to subsurface fibers.

It will be appreciated that the invention does not necessarily require the use of the FIBERWOVEN looms as other types of needle looms may be used, although they would not provide the row chain entanglement of fibers throughout the needled fabric structure. The needled fabric structure utilizing the present invention with a conventional needle loom would have increased fiber entanglement as a result of better needle efficiency without linear needle patterns or needle tracks over the fabric surface normally observed on such looms.

The preferred novel product of the present invention results from a situation wherein the rows of the chain entanglement of fibers are not generally linear and parallel to one another as disclosed in FIG. 15 of U.S. Pat. No. 3,112,552, but on the contrary, the rows have oscillating or substantially sinusoidal configurations in plan elevation with the amplitude of some rows varying from the amplitude of other rows and with the rows in plan elevation crossing over and through one another along the length of the needled fabric product. When employing the FIBERWOVEN technique, chains of entanglement positively interconnect by crossing each other at acute angles. Such novel product as described herein has in the order of 20% greater fiber entanglement than heretofore needled fabric structures for a given number of needle penetrations per unit area. The needled fabric structure of the present invention may be used for end products such as blankets, wearing apparel, draperies or the like wherein such products are subjected to laundering or dry cleaning or it may be used for dense fiber fabric structures such as carpets, upholstery material, and artificial leather and the like, or it may be used for filters, felts, and other products requiring uniformity and tightly entangled, cohering fiber structures.

DETAILED DESCRIPTION OF THE DRAWINGS

The aforementioned invention will appear more fully from the following drawings wherein.

DETAILED DESCRIPTION OF THE INVENTION

Figure 1:
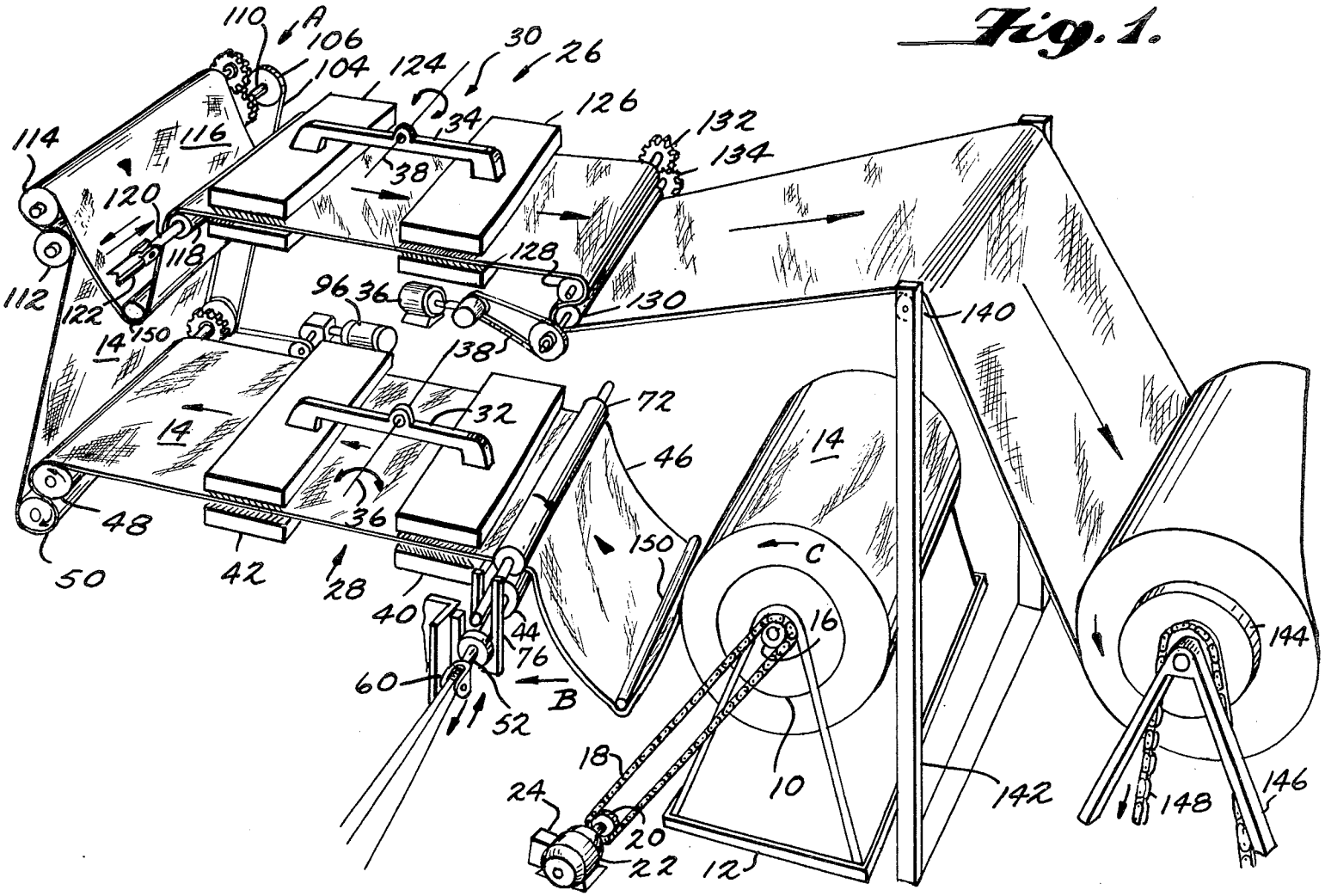
FIG. 1 is a perspective schematic view of a FIBERWOVEN loom used in accordance with the present inventon and illustrating the reciprocation of the web as it enters each of the needling zones to cause oscillation of the web in the needling zones.

Referring now to the drawings wherein like character or reference numerals represent like or similar parts, and in particular to FIG. 1, there is disclosed schematically a system for accomplishing the method, apparatus, and the making of the product of the present invention.

In more detail, a web feed or supply roll 10 supported for rotation on a frame structure 12 provides a source of supply for a web 14 of fibers having some structural integrity. The web 14 of fibers may have been previously needled or may have been "tacked" needled or it may be a web of loosely matted fibers with a foundation. However, if it is a web of loosely matted fibers with a foundation, this is usually made after carding of the web and usually such a web would be fed directly into the needle loom.

The roll 10 has a gear 16 carried on one end thereof and about which extends an endless drive chain 18, the drive chain being driven off of a gear 20 carried on the drive shaft of a variable speed electric motor 22 having speed controls at 24. The motor drives the roll 10 in the direction of the arrow C and feeds th web 14 into a multi-pass needle loom generally designated at 26. The needle loom 26 is schematically shown but it is generally of the type disclosed in U.S. Pat. No. 3,132,406 in that it is provided with two needling zones 28 and 30, one above the other. Of course, the web 14 is fed through these zones in a different path of feed from that shown in the aforementioned U.S. Pat. No. 3,132,406 but one skilled in the art will appreciate that the web could in fact be fed in an identical manner as that disclosed in the patent. Each needle zone or area 28 and 30 includes two pairs of needle boards mounted on rocker arms 32 and 34 and arranged to rock about axes 36 and 38 respectively so that the needle boards of each pair of needle boards alternately penetrate the web 14 as it is passing through the needling zone. In the preferred embodiment, each pair of needle boards had an upper needle board and a lower needle board, both with arrays of needles arranged in successive rows transverse of the machine direction. The needles of the upper board are point on point with the travel in a generally mirror image path of the needles of the lower board and by controlling this with the feed of the web, the chain entanglement of fibers results.

Referring first to needling zone or area 28 which includes the first pair of needle boards 40 and the second pair of needle boards 42, it will be noted that immediately adjacent to the inlet side of the needle zone or area 28 there is provided a free wheeling or freely rotating translating roll 44 over which the web passes into the needling area. Between the roll 44 and the roll 10, a festoon 46 is formed and this provides a substantially untensioned condition in the web 14 as it is being fed into and through the needling zone. On the discharge side of the needling zone or area 28, there are a pair of positively driven draw rolls 48 and 50 remotely spaced from the outlet of the needling zone. The web passes over the roll 48 and between the nip of the rolls 48 and 50 and then under the roll 50 and upwardly toward the upper needling zone or area 30.

Referring back to FIG. 4 of the drawing, it will be noted that the roll 44 is a freely rotating roll in that it is mounted for rotation on a non-rotating shaft 52, the roll having no means of positive rotation. The shaft 52 is provided with a pair of collars 54 (only one shown) on either side of the roll 44 to prevent axial movement of the roll 44 relative to the shaft but permitting rotative movement relative to the shaft. The ends of shaft 52 extend through bearing means 56 (only one shown) on each side of the frame 58 of the loom 26 and one of its ends 60 is bifurcated for receiving the end of a crank arm 62 carried on a crank 64. Crank 64 is rotated by a variable speed motor 66 through a transmission 68 and thus rotary movement is translated into reciprocating movement of the shaft 52. The length of the stroke of reciprocation of the shaft 52 may be varied by adjustment of the position of the crank arm 62 relative to the crank 64 through use of the adjustment means 70. An idler roll 72 carried on a shaft 74 having its ends extending through slots in U-shaped brackets 76 provides a nip through which the web must pass. It will now be obvious that when the web 14 is being pulled through the needling zone or area 28 by the draw rolls 48 and 50, the web will cause the two rolls 44 and 72 to freely rotate on their respective shafts 52 and 74. However, during actual operation the electric motor 66 is driving the crank arm 62 through the crank 64 and is causing the shaft 52 to reciprocate back and forth although this shaft is not rotating. The collars 54 and 73 on the shafts will cause the respective rolls 44 and 72 to move with the shafts while the rolls are being rotated by the web being pulled through the loom. Roll 72 is provided in situations when the web has been dampened to assist in the needling of the same. Its dead weight bearing on the web is sufficient to squeeze any excess needling fluid from the web so that the web is properly saturated during needling. Both the rolls 44 and 72 may be steel rolls with one or both being covered with a friction material such as a pebbled rubber cover or the like. A more detailed description of the purpose of reciprocating the roll 44 and of the purpose of the festoon 46 will follow later in the specification.

Figure 2:
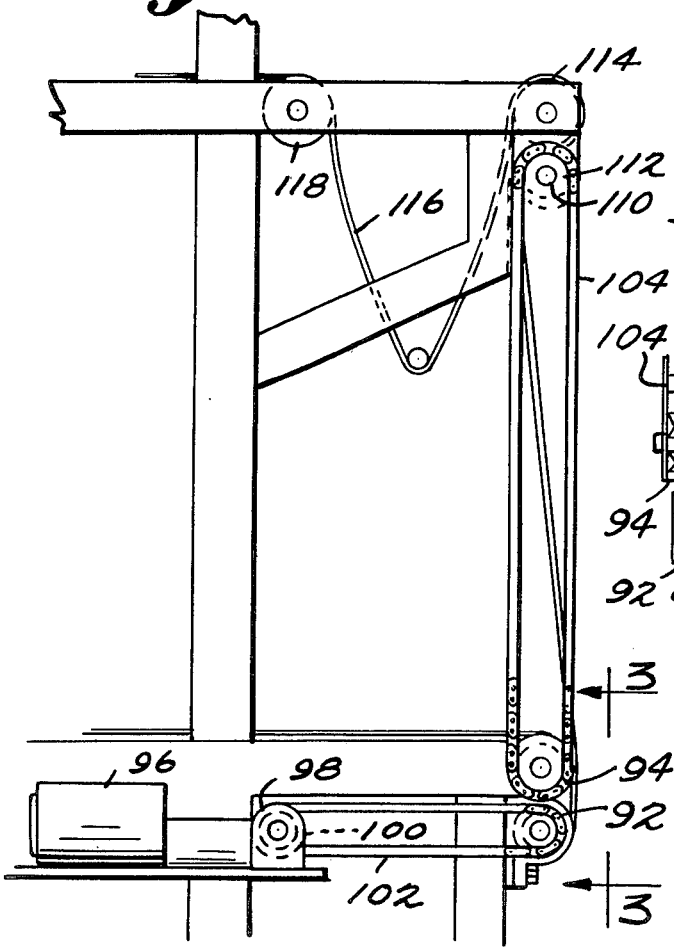
FIG. 2 is a fragmentary side elevational view of the loom looking in the direction of the arrow A of FIG. 1, the view illustrating the drive for the draw rolls of the lower needling zone as well as the means for reducing the tension in the web as it is moved to and through the upper needling zone.
Figure 3:
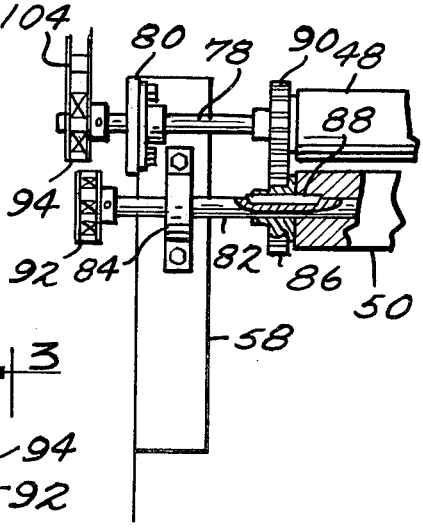
FIG. 3 is a fragmentary sectional view partly in elevation and taken substantially on the line 3—3 of FIG. 2.

Referring now to FIGS. 2 and 3, it will be noted the roll 48 has a shaft 78 with its ends extending through bearings 80 (only one being shown) on the frame 58. By referring to the broken away portion of FIG. 3, it will be noted the shaft 82, extending through bearings 84 (only one being shown) on the frame 58, is keyed to the roll 50 and to a gear or pinion 86 by means of a Woodruff key 88 or the like. In a like manner, the shaft 78 and the roll 48 are keyed to one another and to a gear pinion 90, the pinion 90 meshing with the pinion 86. At the outer ends of the shafts 82 and 78 they are respectively provided with gears or pinions 92 and 94 but these two gears or pinions do not mesh. As shown in FIG. 2, a variable speed electric motor 96 drives through a transmission 98 a gear 100 and an endless gear chain 102 passes about the gears 92 and 98 and this causes the shaft 82 to rotate the roll 50. When the roll 50 is rotating, it rotates the roll 48 through the meshing gears 86 and 90 respectively. An endless gear chain 104 passes about the gear 94 and also about a gear or pinion 106 mounted on a shaft 110 carrying a feed roll 112. The feed roll 112 cooperates with a second feed roll 114 through meshing gears to drive the same and the web 14 passing upwardly from the draw rolls 48 and 50 passes about the feed rolls 112 and 114 and then is formed into a second festoon 116 for reducing the tension in the web.

Figure 4:
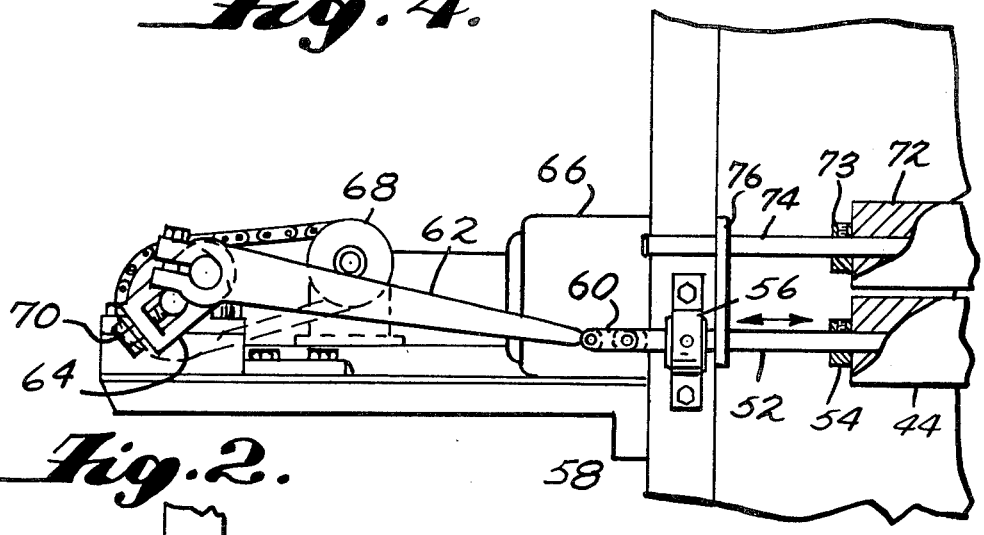
FIG. 4 is a view in the direction of the arrow B of FIG. 1, the view illustrating partly in section and partly in elevation the drive for reciprocating the web in a direction transverse to its movement through the needling zone.

After the web 14 is formed into the second festoon or loop 116 where it is relaxed and is in a substantially untensioned condition, it passes over a free wheeling or freely rotatable translating roll 118 mounted on the non-rotating shaft 120 in a similar manner to the mounting of the free wheeling roll 44 on non-rotating shaft 52. Shaft 120 is connected to a crank arm 122 also arranged to be operated in a similar manner to the crank arm 62 as shown in FIG. 4.

The web then passes into the inlet of the upper needling zone or area 30 which has two pairs of needle boards 124 and 126 respectively where it is needled in substantially an identical manner to the needling in the zone 28.

At a remote distance from the outlet of needling zone 30 there is positioned a further pair of draw rollers 128 and 130, the draw rollers having meshing gears 132 and 134 on one end thereof. The lower draw roller 130 is driven by a variable speed electric motor 136 through an endless chain 138. The needled fabric structure resulting from the needling of the web 14 in needle zones or areas 28 and 30 now passes over an idler roll 140 carried on a frame structure 142 and is wound onto a beam or roll 144 carried on a frame structure 146. Beam or roll 144 is driven by a chain drive 148, the chain drive being driven by a variable speed electric motor (not shown) similar to the motor 22.

The draw rolls 48 and 50 are driven at the same speed as the rolls 112 and 114. Additionally the draw rolls 128 and 130 are driven at the same speed as the aforementioned rolls and once the motors 96 and 136 have been properly synchronized at a desired speed, then there is no longer a necessity to make adjustments to these rolls. However, the feed roll 10 is varying in diameter throughout the operation. This makes it necessary for an operator to adjust the speed of motor 22 by control means 24 occasionally to make up for any overfeeding of the web of the festoon 46. The reverse is true with respect to the take-up roll or beam 144.

As shown in FIG. 1, each of the festoons 46 and 116, which insure relaxation of the web prior to entry into the respective needling zones 28 and 30 and, thus, insure minimum tension of the web within these zones, may be provided with an elongated bar or roller 150 and the purpose of this bar is to control the flopping back and forth of the festoon or loop caused by the reciprocating translation of the web on the rolls 44 and 118 respectively. By such an arrangement, each festoon absorbs the backward motion of the oscillation of the web so that it can extend no further backward than to the takeoff point of the feed or supply roll 10 or to the feed roll 114. The bars or rollers 150 are cylindrical in shape and may be slightly weighted if it is desired to adjust the tension of the web entering the respective needling zones 28 and 30.

As mentioned at the outset of the specification, the web is in a substantially untensioned condition when it enters the inlets of and is within each of the needling zones. The translation back and forth of the rolls 44 and 118 may be in a range to cause an amplitude of movement of the web through a cycle of oscillation at the inlet of a needle zone or area in a range of 0.5 inches to 2.5 inches, the amplitude of the cycle of oscillation of the web decreasing in a forward direction through the entire needle zone to a range of 0.1 inches to 0.3 inches at the outlet of the same. In this respect, the web is advanced forwardly so that each needle in punching the web produces a substantially sine wave path, such advancement for each cycle of translation or oscillations being in a range of 3 to 7 inches for each cycle of oscillation. During the same cycle of oscillation, the arrays of needles preferably penetrate the web in a range in order of 50 to 200 times.

An important factor is the position of the points of penetration of the array of needles relative to the points of previous penetration of the array of the needles. Oftentimes when a web has previously had some needling, the previously oriented fibers will guide and even deflect the needles sidewise from their intended points of penetration. When needles move in a path where previous needles have operated, they are not able to engage fibers immobilized by previous needling, thus, entanglement is impeded. In this invention, it has been found that the non-uniform sidewise movement of the needles will reduce the needles from being deflected by previous fiber orientation and will enhance entanglement and needle efficiency. It is preferred that the sidewise movement of the penetration path of a particular needle of the array of needles between successive penetrations should vary but should be at least in the range of 1/10 to 2 times the maximum width of a needle blade.

The transverse web motion may vary substantially from zero up to and equal to the amount of longitudinal advance between succesive needle penetrations at the inlet of the needle zone.

A typical working example of needling wherein the needled fabric structure is provided with about 20% increase in fiber entanglement and greater density is as follows: The web was shifted back and forth transversely of its direction of movement through the needling zone or area at a rate of 10 cycles per minute with its feed through the needling zone being 42 inches per minute. In the needling zne each needle(which is substantially 20 mils. in width)of each needle board of each pair of needle boards punched the web 850 times per minute. With the above conditions, the amplitude, in plan elevation of the substantially sinusoidal shaped chain entanglement of fibers at the first row of needles was 0.7 inch whereas the amplitude at the last row of needles on the second pair of needle boards adjacent the outlet was 0.1 inch.

Figure 5:
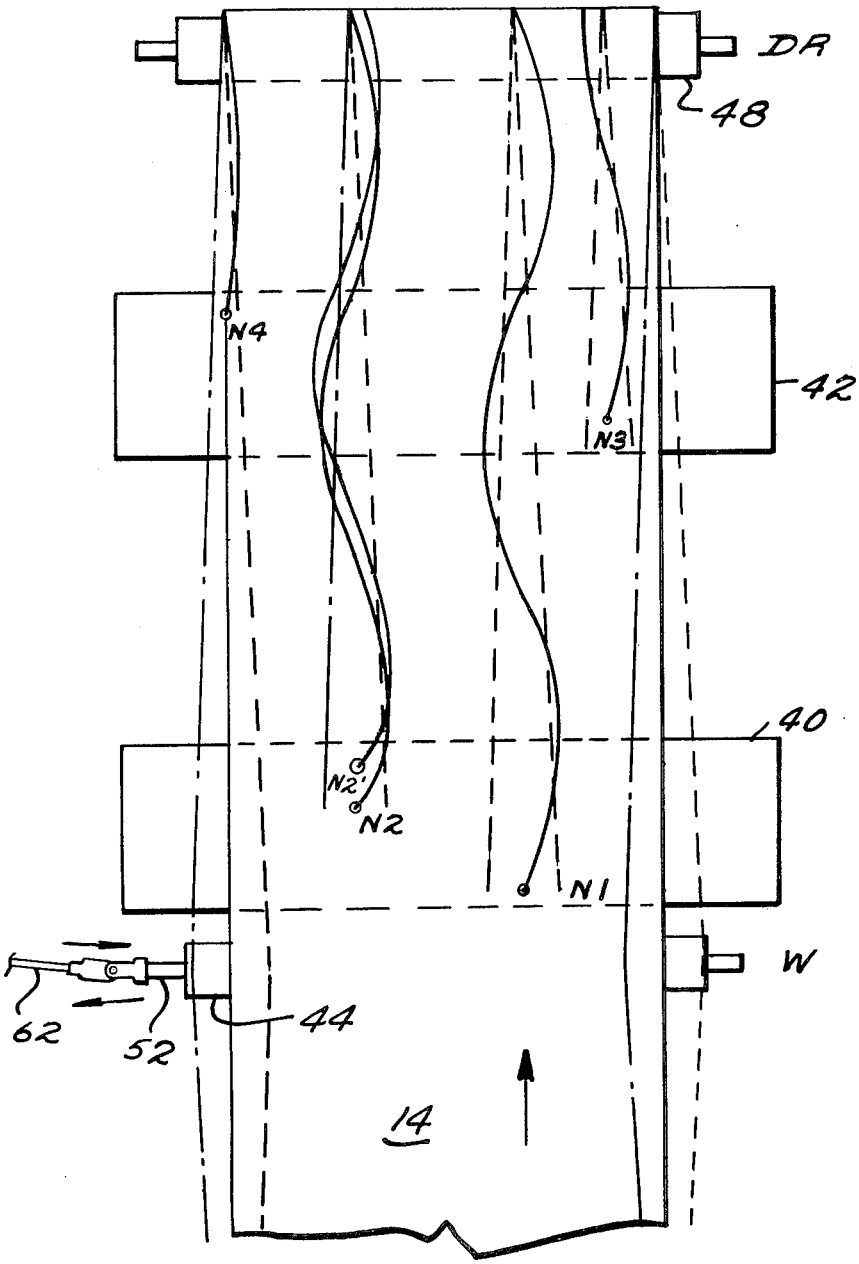
FIG. 5 is a schematic plan view illustrating the needled paths of certain individual needles in the needling zone when the web is moved transversely of its direction of movement through the needling zone, the view also illustrating the decreasing amplitudes of oscillation causing needle paths of different amplitudes.

In FIG. 5 there is disclosed a schematic representation of the web 14 passing through one needle zone or area comprising two pairs of needle boards 40 and 42. Four needles are shown and are identified as N1, N2, N3, and N4. From this schematic view, it will be noted that the sinusoidal shape path in plan elevation caused by needle N1 has a greater amplitude than the path caused by needle N2 and this is also true for the needles N3 and N4. The needle paths in plan elevation as shown in FIG. 5 are substantially sinusoidal and this chain entanglement of fibers in the batt in plan elevation will appear throughout the length of the fabric structure. Of course, it will be appreciated that the chain entanglement of fibers of each of the rows is also from one surface of the batt to the other surface and back again throughout the lengthwise direction of the batt so that in effect, each of the rows of chain entanglement of fibers which has an oscillating configuration not only in plan elevation of the batt throughout the length of the batt but also an oscillating configuration from one surface to the other surface and back again throughout the length of the batt. As will be appreciated by those skilled in the art, each of the needle boards has an array of needles closely spaced apart in successive transverse rows with the rows being offset with respect to one another and, of course, the sinusoidal paths of fiber chain entanglement produced by the needles in plan elevation of the batt cross through, over and under the sinusoidal paths of other individual needles as illustrated in FIG. 5 (note the crossing of paths caused by needles N2 and N2′, for example).

While FIG. 1 of the drawings discloses the use of a freely rotating positively controlled reciprocating roll 44 for imparting movement transverse to the feed direction of the web 14 as it enters the needling zone 28 from the loosely hanging festoon 46, it will be appreciated that the web 14 could be fed directly from the supply roll or beam 10 to the needling zone with the festoon provided intermediate the same, the beam or supply roll 10 being positively reciprocated to cause the transverse movement of the web instead of the roll 44. In this embodiment of the invention, it would be necessary to provide a freely rotating roll in place of the freely rotating and reciprocating roll 44 and means to positively reciprocate the entire feed roll or beam 10 while the beam is still driven at a speed to provide the festoon 46.

Figure 6:
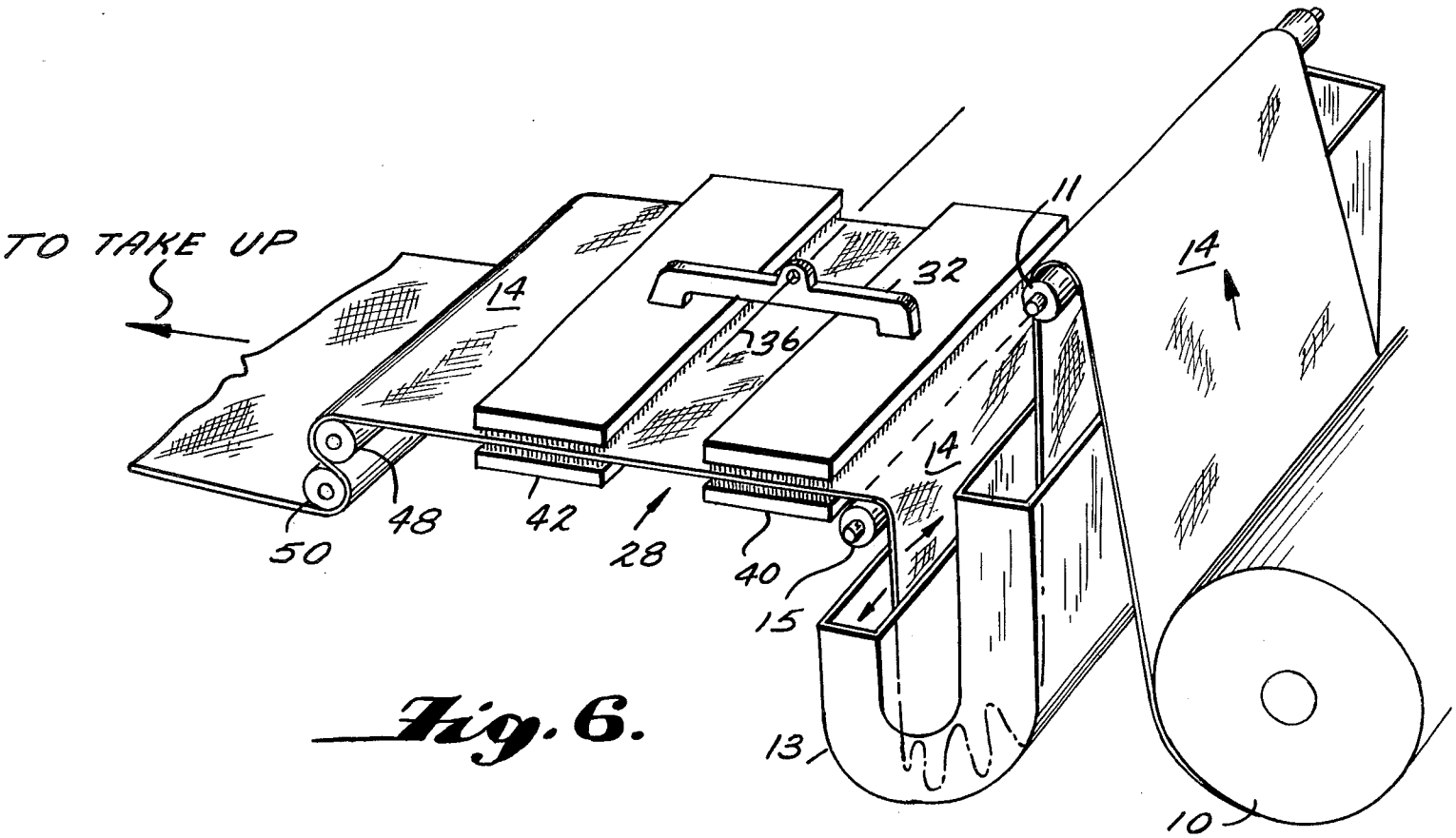
FIG. 6 is a schematic view of a modified arrangement of the present invention wherein the web is introduced into the needling zone in a tensionless condition and without a positive means for moving the web transverse of the feed of the same.

Referring now to FIG. 6 of the drawings, there is disclosed schematically a further embodiment of the present invention wherein the web 14 is introduced into the needling zone 28 in a substantially tensionless condition and without a positive means for moving the web transverse of the feed direction of the same. In this embodiment of the invention, the web 14 is fed from the supply roll or beam 10 over a driven rotating roll 11 wider than the width of the web into a J box 13 also wider than the width of the web. Since the J box 13 is of greater width than the web 14, the web will randomly plait in the J box. To assist in the plaiting of the web 14 in the J box 13, the roll 11 could be replaced with an elliptical shaped driven plaiter roll (not shown) but the plaiting of the web would still form random plaits or irregular folds. The web 14 feeds from the J box 13 over a freely rotating roll 15 into the needling zone 28 and will randomly move or wander transverse of the feed direction through the needling zone because of the random or irregular plaiting of the web in the J box and the tensionless condition of the web in its movement in the feed direction. The arrows shown in FIG. 6 represent a random transverse movement of the web 14 rather than the positive reciprocating movement referred to with respect to the embodiment of FIG. 1. The web 14, after needling in the needling zone 28, passes about the remotely spaced positively driven draw rolls 48 and 50 to a take up which may be a take up roll such as the roll 144 of FIG. 1 or it may pass to a second needling zone (not shown) such as the needling zone 30 of FIG. 1.

While the J box 13 is disclosed as a conventional type of J Box having an inlet and an outlet, it is, of course, within the scope of the present invention that a metal or plastic support, which is J or U shaped, may be used, the support sheet not having the sidewalls or innerwall of the conventional J box. In effect, the J box 13 or support sheet (not shown) provides a festoon for the web 14 just prior to the inlet of the needling zone 28, the festoon being supported at its lowest point of its loop so that there is less weight of the web entering the inlet and being fed through the needling zone. This provides less tension in the web in the needling zone than the simple festoon described in the embodiment of FIG. 1.

The modification of the present invention shown in FIG. 6 could be further modified to provide a positive means for moving the web transverse to the feed direction of the same by utilizing a reciprocating roll, such as the roll 44, in place of the freely rotating roll 15 or by positively reciprocatin g the roll 11.

The preferred embodiment of needled fabric structure utilizes the FIBERWOVEN technique wherein there is a chain entanglement of fibers to obtain the that improved needling characteristics and fiber entanglement by utilizing such an oscillation of the web coupled with relaxing the web at the inlet to the needling zone to a point where the web is substantially untensioned as it passes into and through the needling zone. If there is tension in the web in the needling zone, the fiber entanglement is not improved and about the only thing accomplished is some elimination of tracking of needles.

The terminology used in this specification is for the purpose of description and not limitation, the scope of the invention being defined in the claims.

What is claimed is:

1. A needled fabric structure characterized by having high tensile strength after needling with an improved fiber entanglement comprising: a needled batt having fibers therein coherently oriented throughout the batt from one surface thereof to the other surface in a plurality of rows of fibers extending in a generally lengthwise direction of the batt, each of said rows being a substantially continuous chain entanglement of fibers from one surface to the other surface and back again throughout the lengthwise direction of the batt with each of the rows of chain entanglement of fibers having an oscillating configuration in plan elevation of the batt, and at least some of said rows of chain entanglement of fibers of the batt crossing, recrossing and extending through other of said rows of chain entanglement of fibers as the rows of chain entanglement of fibers extend in a lengthwise direction and oscillate in a widthwise direction as they also extend from one surface to the other surface and back again throughout the length of the batt.

2. A needled fabric structure as claimed in claim 1 in which the oscillating configuration of each of said rows of chain entanglement of fibers in plan elevation has a generally sinusoidal configuration.

3. A needled fabric structure as claimed in claim 2 in which the sinusoidal configuration of some of said rows of chain entanglement of fibers of the batt has a different amplitude in plan elevation from the sinusoidal configuration of other of said rows of chain entanglement of the batt throughout the entire width of said batt.

4. A needled fabric structure as claimed in claim 3 in which the sinusoidal configuration of a row of said rows of chain entanglement of fibers of said batt has a uniform amplitude in plan elevation throughout the length of said batt.

5. A needled fabric structure as claimed in claim 1 in which said rows of chain entanglement of fibers of the batt cross one another at an acute angle to each other in the plan elevation of the batt.

* * * * *